US006932129B2

(12) United States Patent
Hess et al.

(10) Patent No.: US 6,932,129 B2
(45) Date of Patent: Aug. 23, 2005

(54) WOOD PLUG TRIMMER GUIDE

(76) Inventors: Dean W Hess, 2940 N. Il. Rte. 71, Ottawa, IL (US) 61350; Charles J. Hess, 2944 N. Illinois Route 71, Ottawa, IL (US) 61350

( * ) Notice: Subject to any disclaimer, the term of this patent is extended or adjusted under 35 U.S.C. 154(b) by 75 days.

(21) Appl. No.: 10/440,722

(22) Filed: May 16, 2003

(65) Prior Publication Data

US 2004/0250896 A1 Dec. 16, 2004

(51) Int. Cl.[7] ..... B27C 5/10; B27C 1/00

(52) U.S. Cl. ..... 144/136.95; 144/154.5; 408/182

(58) Field of Search ..... 144/135.2, 135.3, 144/136.1, 136.95, 154.5; 408/67, 241 G; 409/181, 182, 137

(56) References Cited

U.S. PATENT DOCUMENTS 2,350,247 A * 5/1944 Newell ..... 74/612
2,491,035 A * 12/1949 Deacon ..... 74/609
3,902,042 A * 8/1975 Goldfarb et al. ..... 219/233
4,290,717 A * 9/1981 Aslen ..... 408/241 G
5,368,424 A * 11/1994 Bettenhausen ..... 409/182
5,988,954 A * 11/1999 Gaskin et al. ..... 408/67

FOREIGN PATENT DOCUMENTS

DE 2341344 * 3/2000

* cited by examiner

*Primary Examiner*—Derris H. Banks
*Assistant Examiner*—Shelley Self
(74) *Attorney, Agent, or Firm*—John P. Cooney

(57) ABSTRACT

The wood plug trimmer is a devise used in conjunction with a hand held grinder that permits expeditious trimming of wooden plugs that are used to cover screws in wooden objects. The wood plug trimmer will have an interior cylindrical shape that will slide over the shank of a hand held grinder. The interior diameter of the wood plug trimmer will be slightly smaller than the exterior diameter of the shank of the hand held grinder and slightly shorter in length than the length of the base of the shank of the hand held grinder to the tip of the grinding die. This will permit the wood plug trimmer to be adjusted so that the grinding die will be flush with the wood surface. The wood plug trimmer will have a plurality of pilot/waste ports that will be wider than the wooden plugs to be trimmed. When in place the wood plug trimmer will have the wood plugs pass through the pilot/waste ports and permit the grinding die to trim the wooden plug flush with the surface. This will eliminate the need for hand tools and expeditiously and safely permit the removal of the excess wood plugs.

9 Claims, 2 Drawing Sheets

WOOD PLUG TRIMMER GUIDE

CROSS-REFERENCE TO RELATED APPLICATIONS

None.

1. Technical Field

The invention relates generally to the trimming of wood plugs that are used in carpentry for the construction of furniture and cabinets and the like that are assembled utilizing a hand held grinder.

2. Background Art

Carpenters utilize wood plugs to cover screws in assembled furniture. After a piece of furniture is created the wood plug is glued into a countersunk hole in order to cover the screw head. The wood plug is generally inserted so that it extends past the wood surface of the furniture's surface. The shape and diameter of the plugs vary and the location of the plugs can be in difficult to reach areas, i.e. joints or corners. Presently carpenters and furniture builders utilize handsaws to trim the plugs down and then to sand the area so that they are flush with the wood surfaces. This process is labor intensive and great care has to be taken so as not to mar the wood surface. The present art does not disclose any devises that can be used to trim wood plugs on assembled wood furniture or cabinets, in particularly those plugs located in areas that abut other surface that form an angle. The present invention is utilized with hand held grinders that are portable and can fit into tight places on furniture.

OBJECTS OF THE INVENTION

One object of the invention is to provide a devise to easily trim wood plugs that are used in filling of countersunk screw holes created in the construction of wood furniture and cabinets that will also protect against injuring or scaring the surface of the wood product. Another object of the invention is to provide a hand held devise that will permit easy access to areas that cannot otherwise be reached by other plug trimming devises. Another object of the invention is to fulfill the need in the furniture industry for a hand held devise that would trim wooden plugs flush without marring the wood surface.

DISCLOSURE OF THE INVENTION

A wood plug trimmer, in accord with the invention, comprising a cylindrical element of a fixed diameter and length to attach to a hand held grinder. The length and the diameter of the cylindrical element will be dependent upon the size circumference and depth of the shank area of a particular hand held grinder it is to be used in conjunction with. The interior circumference of the cylindrical element will be of slightly smaller diameter than the outer circumference of the shank of the hand held grinder. The length of the cylindrical element will be slightly shorter than length of the end of the base of the shank to the end of the grinding die attached thereto. The cylindrical element will be cut along the length of the cylindrical element so that it will permit the cylindrical element to expand to slide over the shank. The bottom end of the cylindrical element will fit around the shank and will have a means to secure the element to the shank so that the cylindrical element will extend from the hand held grinder at a plurality of positions. The end of the cylindrical element that is opposite to the hand held grinder will have two or more openings that will act as pilot guides in order to move over the wood plugs and waste disposal ports for the wood material trimmed from the plugs. The wood plugs will be able to pass through the pilot/waste ports and the waste material created from the removal of the wood plug will come out the ports. Each of the openings will be large enough to permit the wood plug to go through them. The distance the element shall extend from the die hand held grinder will be able to be adjusted so that the grinding end of the die hand held grinder will run flush against the wood surface so that the wood plug will be cut down to the wood surface. (Claim 1)

In accord with one aspect of the invention, the cylindrical element will be held in place on the die hand held grinder by a fastener element that will fit around the exterior of the cylindrical element and hold the cylindrical element in place. (Claim 2)

In accord with one aspect of the invention, the fastener element will be a hose clamp. (Claim 3)

In accord with one aspect of the invention, the fastener element will be a ring spring fastener. (Claim 4)

In accord with one aspect of the invention, the fastener element will be cable ties. (Claim 5)

Preferably the cylindrical element will be manufactured using PVC tube (Claim 6).

In accord with one aspect of the invention, the cylindrical element will be manufactured using polymer. (Claim 7)

In accord with one aspect of the invention, the cylindrical element will be manufactured out of wood (Claim 8)

In accord with one aspect of the invention, the cylindrical element will be manufactured out of metal (Claim 9).

DETAILED DISCLOSURE OF INVENTION

Figure 1:
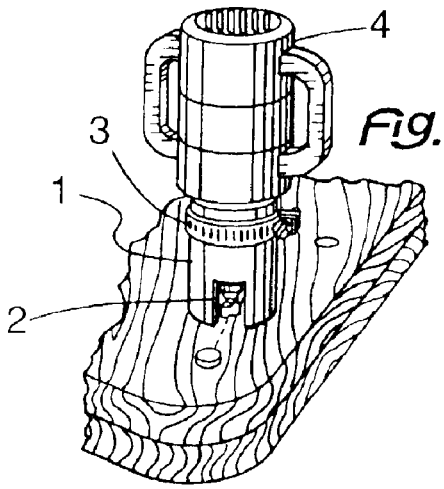
FIG. 1 is a perspective view of the first embodiment of the invention showing the application of the invention to a hand held grinder on a wood surface with wooden plugs in place by means of attachment being in this figure a hose clamp. This Figure shows how the pilot/waste ports will permit the devise to pass over the wooden plugs allowing the die grinder to grind them flush with the wood surface.

Referring to the drawings, FIG. 1 illustrates the wood plug trimmer's cylindrical element (1) as it is in place on a hand held grinder (4) and attached thereto utilizing a hose clamp element as a means of attachment (3). The cylindrical element (1) has pilot/waste port elements (2) located at the end of the wood plug trimmer that comes in contact with the wood surface and are wide enough to permit the wooden plugs that are to be trimmed to pass through the pilot/waste port elements (2). The cylindrical element (1) is of a slightly shorter length than the grinding end of the hand held grinder's shank element's (9) base to the end of the grinding die element (8), so that it can be adjusted to permit the grinding die element (8) to be flush with the wood surface so the wooden plugs that it grinds will be flush with the wood surface. The cylindrical element (1) will have a linear cyt (7) that will run the entire length of the cylindrical element (1).

Figure 2:
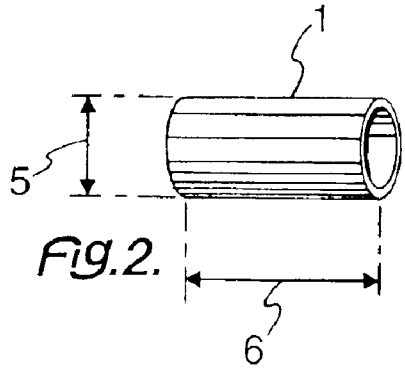
FIG. 2 is a perspective view of the invention showing the dimensions of the invention that is referred to in the claims and drawings.

FIG. 2 shows the dimensional view of the invention showing the inner dimension (5) and the length (6).

Figure 3:
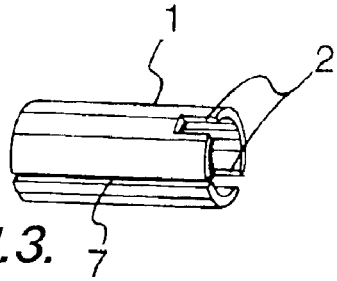
FIG. 3 is a perspective view the details of the cylindrical element of the invention, which shows the linear cut and the waste ports.

FIG. 3 shows a profile of the invention. FIG. 2 shows the linear cut (7) in the cylindrical element (1). FIG. 2 further shows the pilot/waste port elements (2)

Figure 4:
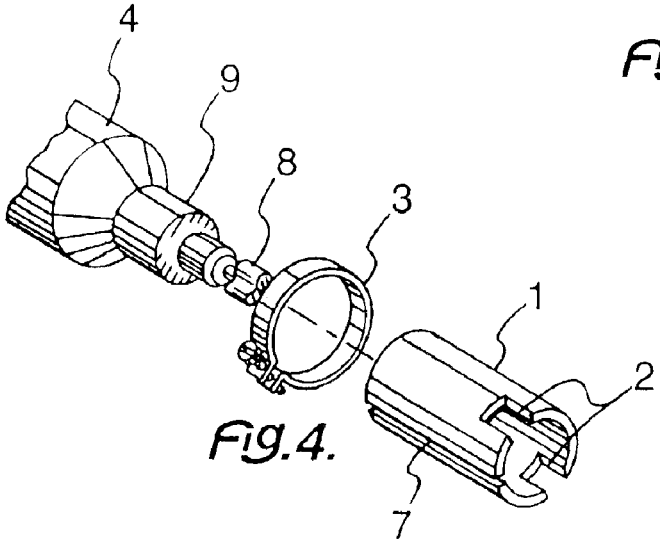
FIG. 4 is an expanded view of the invention as it relates to the positioning of the invention over the shank of the hand held grinder and through the hose clamp fastener.

FIG. 4 shows an exploded view of the invention as it relates to the hand held grinder (4). The cylindrical element (1) will be placed over the shank element (9) of the hand held grinder (4) thus permitting the grinding die element (8) to extend to the wood surface at the opposite end of the cylindrical element (1) and will be held in place by a means of attachment this being a hose clamp fastener element (3). FIG. 2 further shows a pilot/waste port element (2) in relationship to a wood plug on a wood surface.

Figure 5:
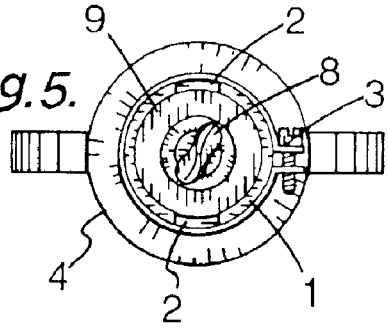
FIG. 5 is a view of the invention from the bottom with the invention over the hand held grinder's shank and held in place by means of a hose clamp.

FIG. 5 shows a bottom view of the invention that is in place on the grinder (4). FIG. 5 shows the cylindrical element (1) with two pilot/waste port elements (2) and attached by a hose clamp element being the means of attachment (3). The cylindrical element is placed over the shank element (9) and the grinding die element (8) is located in the center of the cylindrical element (1) so that the pilot/waste port elements (2) will permit the wooden plugs to pass through them and come in contact with the grinding die element (8) and be ground flush with the wood surface.

Figure 6:
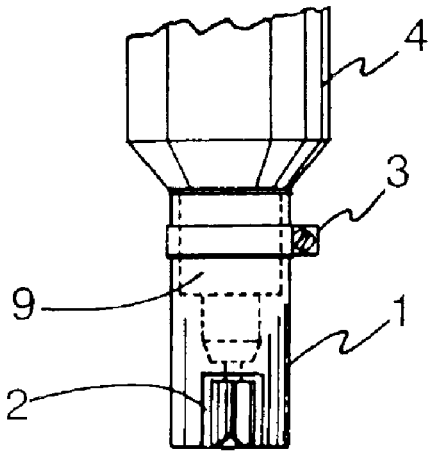
FIG. 6 is a profile view of the invention utilizing the hose clamp fastener on the grinder as it relates to being place on a wood surface and the die grinder end being adjusted to be flush with the wood surface.

FIG. 6 shows a profile view of the invention with a shadow of the shank element on a wooden surface. FIG. 6 shows the cylindrical element (1) placed over the shank element (9) and held in place by a hose clamp element as the means of attachment (3). FIG. 6 further shows the grinding die element (8) extending to the most outward point of the cylindrical element (1) as seen through the pilot/waste port elements (2) so that the end of the cylindrical element in contact with the wood surface shall extend from the hand held grinder (4) so the grinding die element (8) is flush with the wood surface.

Figure 7:
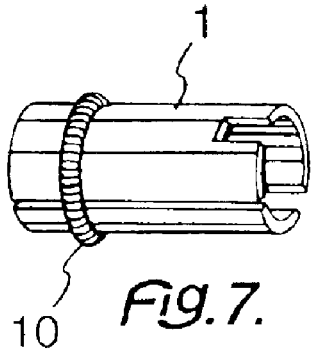
FIG. 7 is a perspective view of the invention utilizing a ring spring fastener as a means of attachment.

FIG. 7 shows a profile view of the invention that utilized as the means of attachment being a ring spring fastener element (10).

Figure 8:
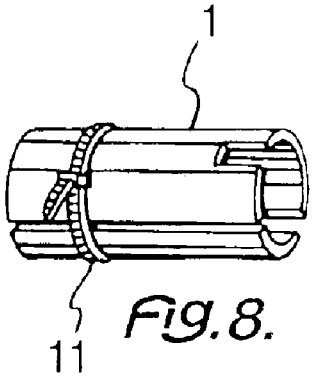
FIG. 8 is a perspective view of the invention utilizing cable ties as a means of attachment.

FIG. 8 shows a profile view of the invention that utilized as the means of attachment being a cable tie element (11).

What is claimed is:

1. A wood plug trimmer comprising:

a cylindrical element a hand held die grinder, said hand held die grinder having a first and second end, a shank element having an exterior diameter and having a base and said shank element base operatively connected to said hand held grinder's second end.

a grinding die element operatively coupled to said shank element base's end that is opposite of the shank element base connected to the hand held grinder, said grinding die element used for trimming wood plugs from a wood surface work piece;

said hand held die grinder's shank portion, said shank element base and said grinding die element defining a total length;

said cylindrical element having an inner diameter slightly less than said exterior diameter of said hand held die grinder's shank element, said cylindrical element having a length shorter than said total length of said grinder's shank portion, shank element and grinding element;

said cylindrical element having a first end operatively attachable to said hand held die grinder and a second opposite open end said cylindrical element having a linear cut extending longitudinally the entire length of said cylindrical element, wherein said linear cut allows said cylindrical element to be enlarged to be placed over said hand held die grinder's shank element, wherein said cylindrical element can be placed in a plurality of locations along said hand held die grinder's shank to permit said second opposite open end of said cylindrical element to be moved such that said grinding die element of said hand held die grinder can be lowered to said wood surface work piece to trim wood plugs;

said cylindrical element having a plurality of pilot/waste port elements on said second opposite open end, wherein said pilot/waste port elements allow passage of wooden plugs that extend from said wood surface work piece and are trimmed by said hand held die grinder.

2. The wood plug trimmer as described in claim 1 wherein the cylindrical element is held in place on the shank of said hand held grinder by a means of attachment.

3. The wood plug trimmer as described in claim 2 wherein the means for attachment is a hose clamp fastener.

4. The wood plug trimmer as described in claim 2 wherein the means for attachment is a ring spring fastener.

5. The wood plug trimmer as described in claim 2 wherein the means for attachment is a cable tie.

6. The wood plug trimmer as described in claim 1 wherein the cylindrical element is manufactured using a PVC tube.

7. The wood plug trimmer described in claim 1 wherein the cylindrical element is manufactured using a polymer.

8. The wood plug trimmer described in claim 1 wherein the cylindrical element is manufactured out of wood.

9. The wood plug trimmer described in claim 1 wherein the cylindrical element is manufactured out of metal.

* * * * *